United States Patent [19]

Terrell

[11] 4,259,770

[45] Apr. 7, 1981

[54] APPARATUS FOR REMOVING ROVING OR THE LIKE FROM TEXTILE BOBBINS OR THE LIKE

[75] Inventor: Robert E. Terrell, Charlotte, N.C.

[73] Assignee: The Terrell Machine Company, Charlotte, N.C.

[21] Appl. No.: 52,071

[22] Filed: Jun. 25, 1979

Related U.S. Application Data

[63] Continuation-in-part of Ser. No. 900,761, Apr. 27, 1978.

[51] Int. Cl.[3] ..... B65H 73/00

[52] U.S. Cl. ..... 28/294

[58] Field of Search ..... 28/293, 294, 296

[56] References Cited

U.S. PATENT DOCUMENTS

| | | | |
|---|---|---|---|
| 1,705,426 | 3/1929 | Terrell | 28/296 |
| 3,163,913 | 1/1965 | Gwaltney et al. | 28/296 X |
| 3,289,266 | 12/1966 | Brown, Jr. et al. | 28/294 |

*Primary Examiner*—Robert Mackey

*Attorney, Agent, or Firm*—Richards, Shefte & Pinckney

[57] ABSTRACT

The apparatus has two pairs of long driven nip rolls on which bobbins with residual roving are advanced axially in a row with the nip rolls engaging the ends of residual roving and unwinding the roving into a delivery plenum therebelow through which the roving is drawn by suction to the surface of a rotating perforated delivery drum through which the suction is drawn to retain the roving thereon as the drum rotates the roving to a discharge plenum in which a shredding drum shreds the roving for discharge in pieces through a discharge plenum. A baffle plate is mounted closely adjacent the delivery drum to confine suction through the drum and to allow roving to be transported on the delivery drum between the drum and the plate and extends adjacent the shredding drum to confine the roving thereto. In one embodiment, the baffle plate is perforated to allow suction to be drawn through the plate into the drum and to direct roving to the shredding drum. In an alternate embodiment, the baffle plate is spring biased toward the delivery drum and the shredding drum to permit movement thereof away from the drums to accommodate passage of varying size roving material between the drums and the baffle plate.

24 Claims, 9 Drawing Figures

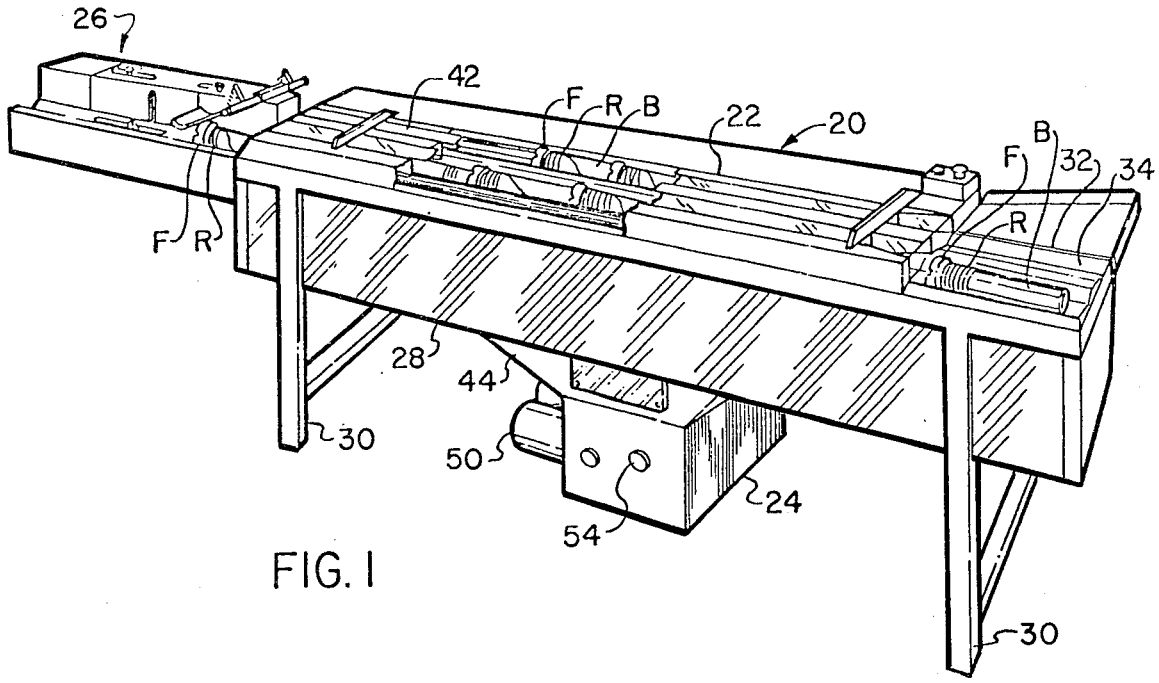
FIG. 1
FIG. 2
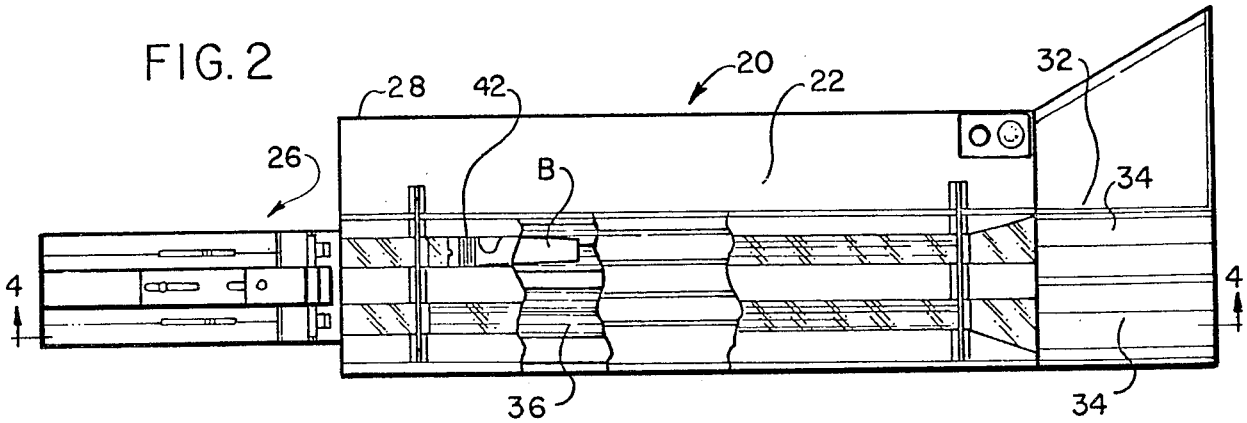
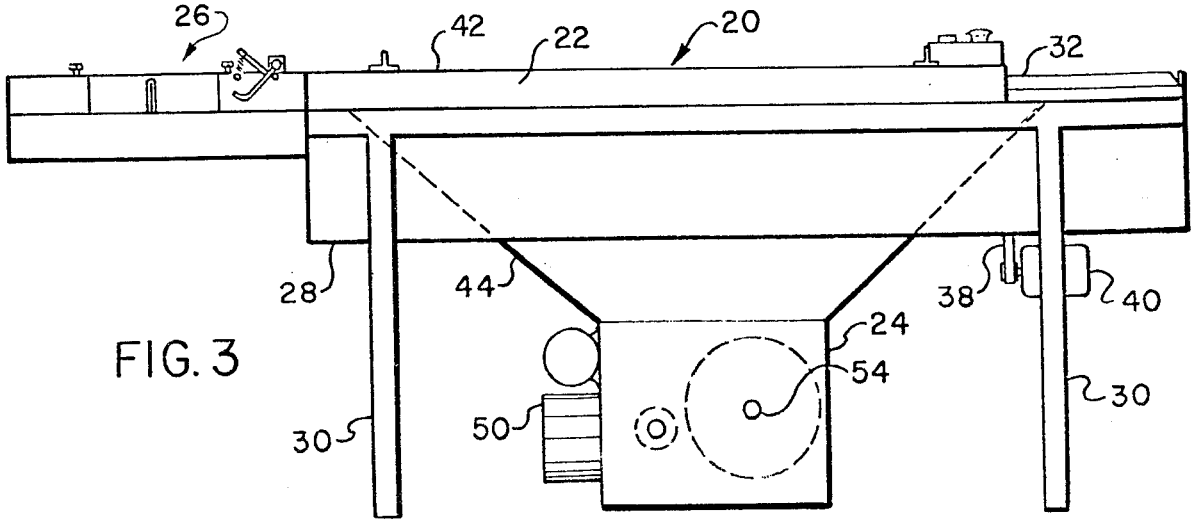
FIG. 3

APPARATUS FOR REMOVING ROVING OR THE LIKE FROM TEXTILE BOBBINS OR THE LIKE

CROSS-REFERENCES TO RELATED APPLICATIONS

The present application is a continuation in part of co-pending U.S. application Ser. No. 900,761, filed Apr. 27, 1978.

BACKGROUND OF THE INVENTION

This invention relates in general to an apparatus for removing wound material from a carrier core. More particularly, the present invention relates to the removal of residual or waste roving from bobbins from which roving packages have been unwound in textile spinning operations and that must have the waste roving cleared therefrom before they can be reused satisfactorily to receive a new roving supply package for delivery again to a spinning operation.

A typical prior art roving removal apparatus of this general type is disclosed in Gwaltney et al U.S. Pat. No. 3,163,913 issued Jan. 5, 1965, which discloses a pair of nip rolls along which bobbins are advanced in a row and rotated for engagement of the ends of residual roving on the bobbins in the roll nip, which unwinds the roving and feeds it onto a conveyor belt for transport to a pair of back rolls from which the roving feeds to a pair of drafting rolls that provides a loosening or opening draft on the roving. The bobbins advance from the nip rolls onto a chute along which they slide into a collection cart or box. This apparatus has proven commercially effective, but it requires a driven conveyor and pairs of back and drafting rolls, and the necessary spacing between the nip of the back rolls and the nip of the drafting rolls results in a short length at the end of the roving being released by the back rolls without drafting between the back and drafting rolls.

SUMMARY OF THE PRESENT INVENTION

The present invention is an improvement of the apparatus of the Gwaltney U.S. Pat. No. 3,163,913 as it provides a simplified arrangement for shredding the unwound roving and importantly does so in a manner that effectively shreds substantially the entire length of unwound roving, including the trailing end.

Briefly described, the apparatus for shredding textile roving or the like into short pieces according to the present invention includes a housing formed with a delivery plenum into and through which a strand of roving may be drawn by suction and a discharge plenum through and from which shredded pieces of roving may be drawn by suction. A hollow perforated delivery drum is mounted for rotation in the housing between the plenums and is disposed for drawing of suction through the surface thereof at the delivery plenum interiorly across the drum and outwardly through the surface thereof at the discharge plenum. Means are provided for rotating the drum to transport roving received thereon at the delivery plenum and retained thereon by suction to the discharge plenum for discharge of the roving therefrom by the suction drawn through the drum and the discharge plenum. Baffle means is disposed between the plenums and closely adjacent the exterior surface of the drum for confining the drawing of suction primarily through the drum while allowing roving to be transported on the drum between the drum and baffle means. Means is located in the discharge plenum adjacent the drum for shredding the roving delivered thereto by the drum and suction, with the suction in the discharge plenum discharging the shredded roving therefrom.

Preferably, the baffle means is a plate disposed adjacent the drum to define a passage for roving transported on the drum from the delivery plenum to the discharge plenum and the shredding means is disposed adjacent the baffle means for shredding engagement of the roving as it enters the discharge plenum from the passage between the baffle means and the delivery drum. In the preferred embodiment, the shredding means is a shredding drum and the plate of the baffle means extends adjacent the shredding drum and is perforated for drawing of suction therethrough into the discharge plenum to direct the roving toward the shredding means.

In one preferred embodiment, the baffle means plate is arcuately curved adjacent the delivery drum and arcuately curved adjacent the shredding drum with the angle therebetween being acute and past which the roving advances to the shredding drum. In this embodiment, the plate of the baffle means is perforated for drawing of suction therethrough into the drum to facilitate retention of the roving on the drum between the drum and baffle means and to resist drawing of suction between the drum and baffle means from the delivery plenum.

In another preferred embodiment, the baffle means plate is generally V-shaped having two walls converging toward the delivery drum to a vertex closely adjacent the exterior surface of the drum and extending therealong to define the passage therewith. In this embodiment, the plate is retained between two spaced guide plates mounted in the housing and converging toward the delivery drum outwardly along the walls of the plate in general correspondence therewith and is yieldably biased toward the delivery drum and the shredding drum by spring means engaging the plate at its vertex oppositely of the delivery drum and extending away from the delivery drum into engagement with the housing, thereby permitting movement of the plate away from the drums to accomodate passage of varying size roving material through the passage and between the plate and the shredding drum.

The shredding apparatus of the present invention may be combined with nip rolls mounted on the housing at the delivery plenum for engaging the end of a strand of residual roving on a bobbin rotating on the rolls to unwind the roving from the bobbin and feed it into the delivery drum. This arrangement can be combined in the present invention with an apparatus for selectively removing bobbins that have residual roving thereon from a row of bobbins advancing from the nip rolls, an example of such an apparatus for selectively removing bobbins being illustrated and described in co-pending U.S. patent application Ser. No. 900,761, filed Apr. 27, 1978.

BRIEF DESCRIPTION OF THE DRAWINGS

FIG. 1 is a perspective view of an apparatus for removing roving from textile bobbins according to the preferred embodiment of the present invention;

FIG. 2 is a plan view, partially broken away, of the apparatus of FIG. 1;

FIG. 3 is an elevation view of the apparatus of FIG. 1;

DESCRIPTION OF THE PREFERRED EMBODIMENTS

Figure 4:
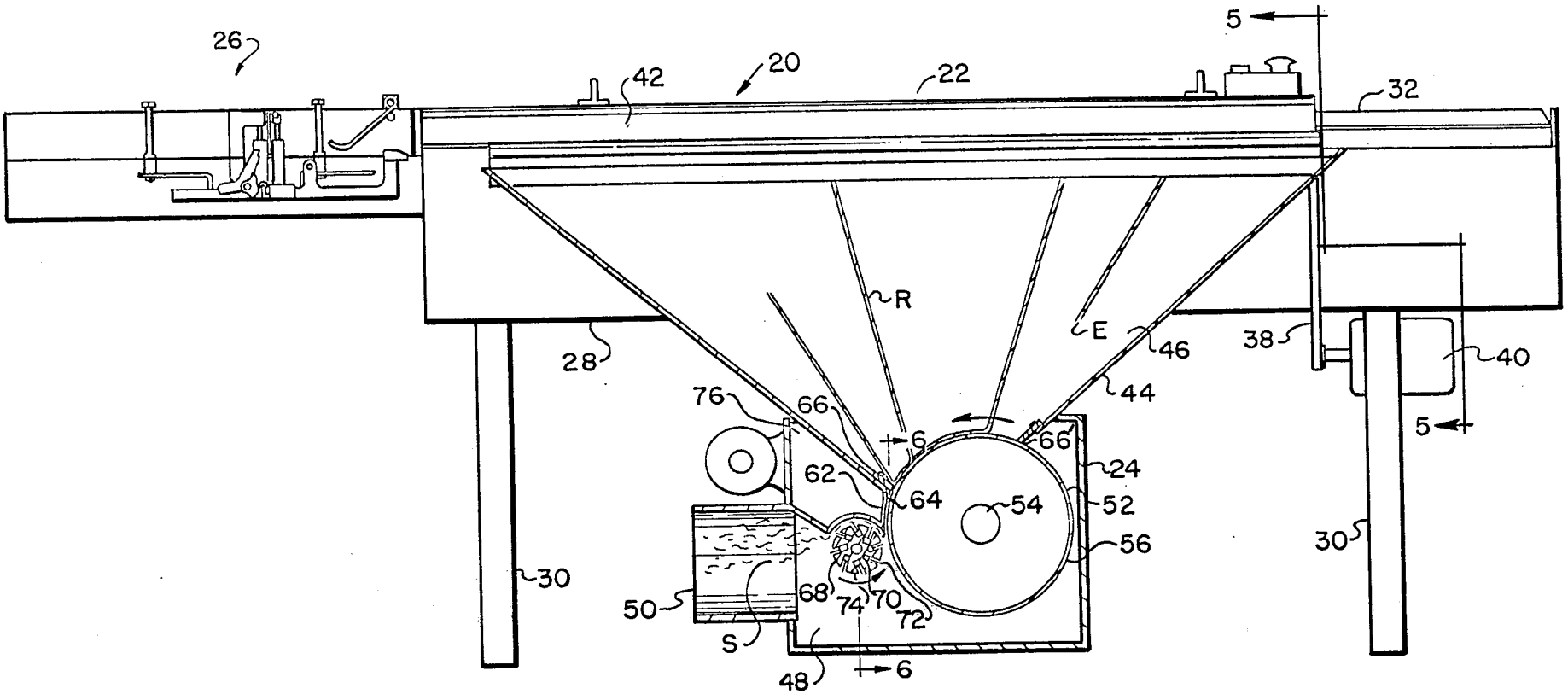
FIG. 4 is an enlarged vertical section view taken along line 4—4 of FIG. 2.
Figure 5:
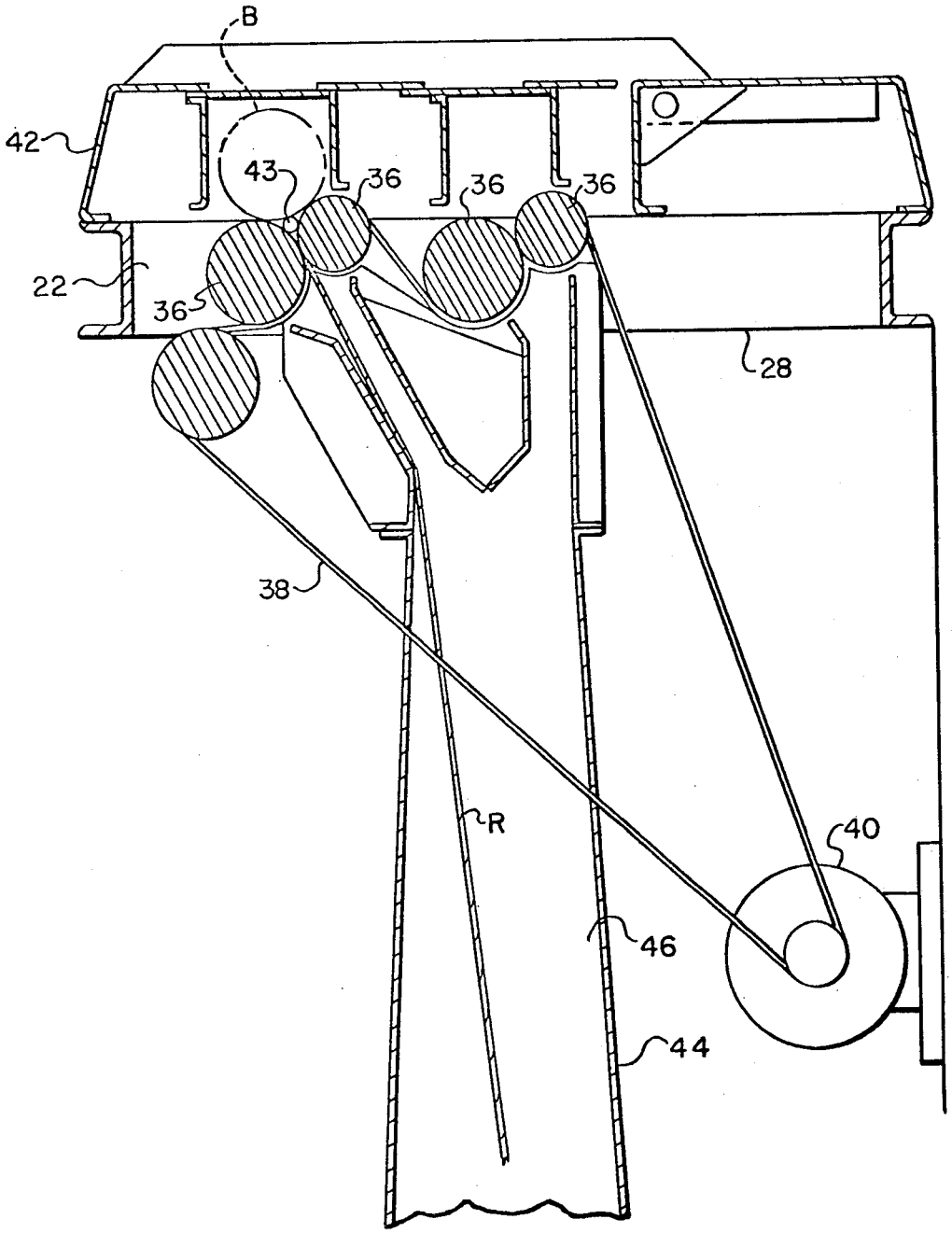
FIG. 5 is an enlarged vertical sectional view taken along line 5—5 of FIG. 4 showing the apparatus for unwinding roving from a bobbin.
Figure 6:
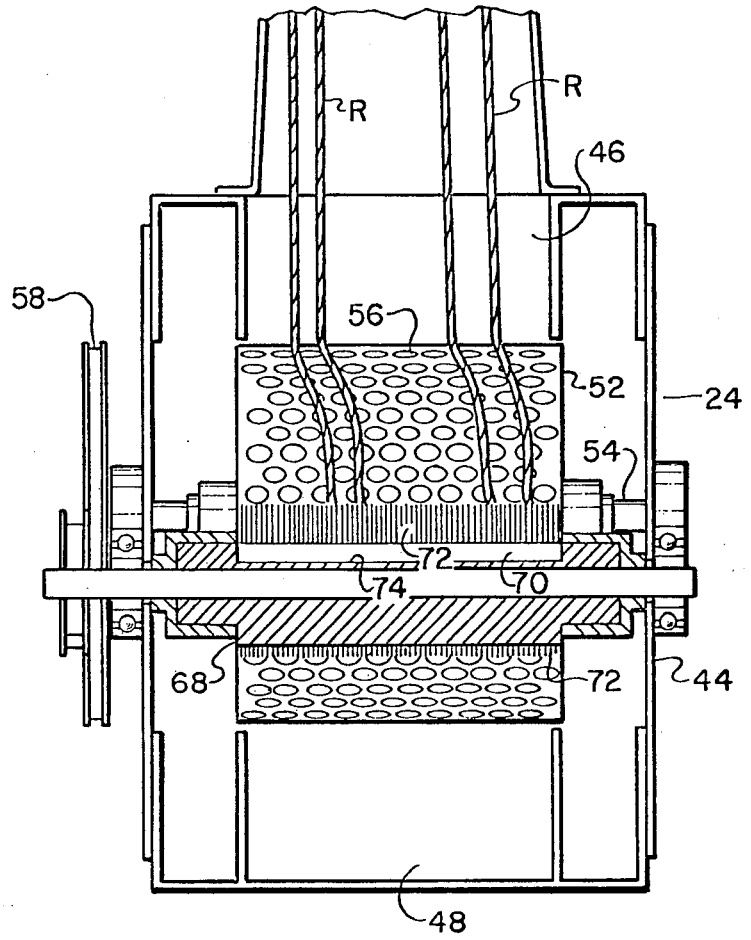
FIG. 6 is an enlarged vertical sectional view taken along line 6—6 of FIG. 4 with the baffle plate removed and showing the apparatus for shredding roving.
Figure 7:
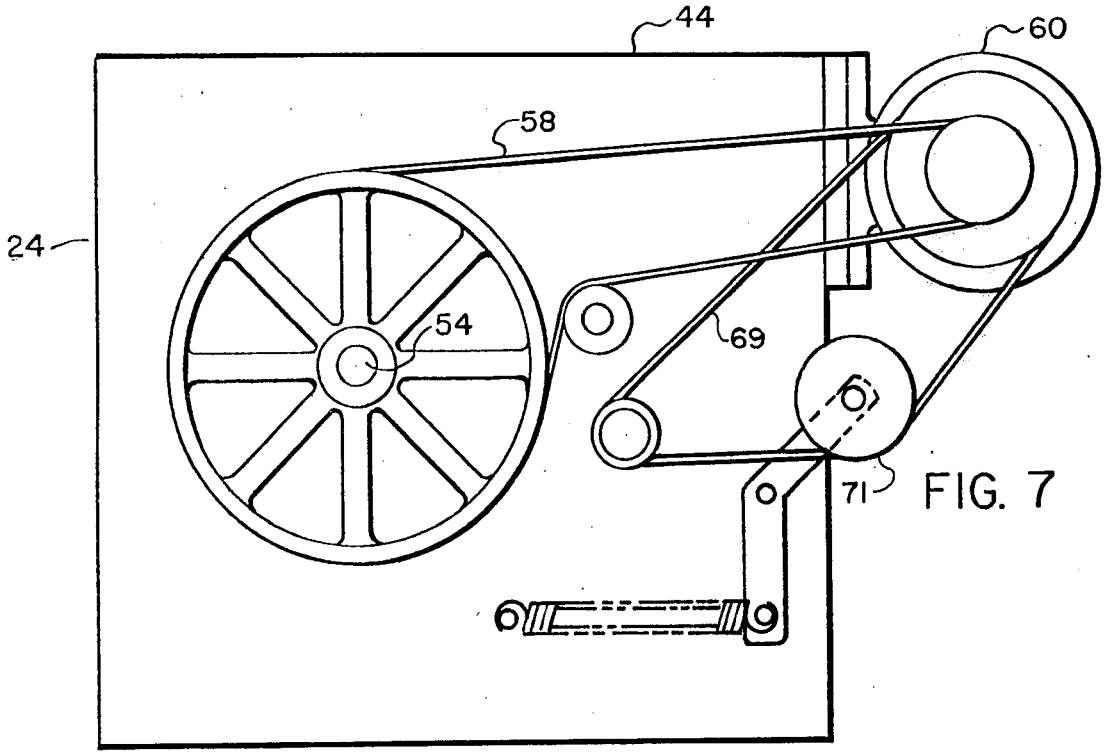
FIG. 7 is an enlarged elevational view of the shredding apparatus of FIG. 6 as viewed from the left of FIG. 6.

Referring to the drawings, the preferred embodiment of the present invention is shown incorporated in a machine 20 for removing roving R from textile bobbins B for recycling of the bobbins in a textile spinning operation. The machine 20 combines apparatus 22 for unwinding roving R from the bobbins B, apparatus 24 for shredding the roving R into short pieces S, and apparatus 26 for removing bobbins having residual roving thereon following the unwinding operation.

All of the components of the machine of the preferred embodiment are mounted on a main frame 28 supported on legs 30. Bobbins B are advanced through the machine 20 manually from a feeding platform 32 at the right (FIG. 1) of the machine. This platform 32 is provided with a pair of parallel troughs 34 in which bobbins B are placed and pushed along by the operator to form two rows of bobbins that are advanced through the machine by the operator pushing bobbins against the end of the row at the feeding platform 32. These troughs 34 are aligned with two pairs of horizontally extending nip rolls that are driven through a belt drive 38 from an electric motor 40. The bobbins B are retained in position on the nip rolls 36 and protected by a cover 42 that is pivoted on the main frame 28 for positioning in either a bobbin covering disposition during operation of the machine or in a raised position to allow access to bobbins.

The nip rolls 36 of each pair rotate in opposite directions and one roll of each pair is covered with a friction material to impart rotation to the bobbins supported thereon. The rotation of the bobbins B causes the extending ends E of roving thereon to project outwardly by centrifugal force and be engaged in the nip of the rolls, the rotation of which causes the roving ends E to be engaged and pulled downwardly in a roving unwinding direction as the bobbins B continue to be rotated. A small free rolling rod 43 is supported on the rolls to facilitate the positioning of the bobbins for rotation and to form a nip close to the bobbins to facilitate engagement of the roving in the nip of the rolls 36.

The aforementioned shredding apparatus 24 is mounted on the main frame 28 directly below the nip rolls 36. This shredding apparatus 24 is supported in a housing 44 supported from and depending below the main frame 28. The housing 44 is formed with a delivery plenum 46 that is open under the full length of the nip rolls 36 and tapers downwardly to a discharge plenum 48 therebelow from which shredded roving pieces S are discharged.

Suction is imposed by any conventional means at the discharge end 50 of the discharge plenum 48 to draw suction down through the delivery plenum 46 and through the discharge plenum 48 to the discharge end 50 thereof, thereby drawing roving R being unwound from the bobbins B by the nip rolls 36 through the shredding apparatus 24 for shredding and discharge as shredded pieces S.

A hollow perforated delivery drum 52 is mounted for rotation in the housing 44 between the delivery plenum 46 and discharge plenum 48 on an axial shaft 54 disposed horizontally and transversely with respect to the axis of the nip rolls 36. The suction drawn through the delivery plenum 46 and discharge plenum 48 is drawn through the perforated surface 54 of the delivery drum 52 at the delivery plenum 46, interiorly across the drum 52 and outwardly through the surface 56 thereof at the discharge plenum 48. The drum 52 is rotated counterclockwise (FIGS. 3 and 4) by a belt drive 58 connected to the shaft 54 from a drive motor 60 mounted on the housing 44.

With this plenum, drum and suction arrangement, roving is drawn by suction onto the surface 56 of the drum 52 and carried thereon by rotation of the drum to the discharge plenum at which the suction draws the roving from the drum surface 56. To confine the drawing of suction primarily through the drum rather than around the outside of the drum, baffle means in the form of a plate 62 is disposed between the plenums and closely adjacent the exterior surface 56 of the delivery drum 52. This baffle plate 62 extends across the housing 44 and provides only a small passage 64 between the drum and plate sufficient only to allow roving R on the drum surface 56 to pass therethrough from the delivery plenum 46 to the discharge plenum 48. The confining of suction to pass through the delivery drum 52 is further facilitated by adjustable end plates 66 and 66' mounted on the bottoms of the transverse walls of the delivery plenum 46 at the delivery drum 52.

Means is disposed in the discharge plenum 48 adjacent the delivery drum 52 for shredding roving delivered thereto by the drum and suction. In the illustrated embodiment, the shredding means is in the form of a shredding drum 68 mounted across the discharge plenum 48 for rotation about a horizontal axis transverse to the axis of the nip rolls and parallel to the axis of the delivery drum 52, with rotation provided by a V-belt drive 69 from the motor 60. The V-belt drive 69 is trained about a spring biased idler roller 71 to provide uniform tensioning thereof. The shredding drum 68 carries a plurality of combs 70 of shredding teeth 72 in longitudinal grooves 74 recessed in the surface of the shredding drum 68. Alternatively, a plurality of saw blades (not shown) having saw teeth may be utilized in longitudinal grooves 74, or the shredding drum 68 may instead be helically wrapped with conventional card clothing (also not shown). The shredding drum 68 is disposed close to the delivery drum 52 so that the teeth 72 will engage roving as it leaves the delivery drum surface 56, and the shredding drum 68 is rotated by the aforementioned belt drive 69 and drive motor 60 at a surface speed substantially faster than that of the delivery drum so that the shredding drum teeth 72 have a loosening, opening, and shredding action on the roving to shred it into small pieces S.

In one embodiment of the present invention, the aforementioned baffle plate 62 is curved arcuately in conformance with the curvature of the delivery drum 52 to define the aforementioned passage 64 and is perforated along the delivery drum 52 for drawing of suction through an auxiliary plenum formed in the housing 44 behind the baffle plate 62 and communicating with the atmosphere. In this manner, suction is drawn through the auxiliary plenum 76, perforated baffle plate 62, across the passage 64 and through the interior of the perforated delivery drum 52. This auxiliary suction facilitates retention of the roving R on the delivery drum 52 as it passes through the passage 64, and the auxiliary suction also forms a barrier to resist the drawing of suction through the passage 64 from the delivery plenum 46 to the discharge plenum 48. To prevent large clumps of roving from jamming in the passage 64 and to permit at least some roving clumps to pass therethrough, a clearance of approximately one-fourth of an inch is provided in the passage 64 between the baffle plate 62 and the delivery drum 52.

The baffle plate 62 extends from adjacent the delivery drum 52 into the discharge plenum 48 closely adjacent the toothed surface of the shredding drum 68 to confine the roving R closely to the shredding drum 68 as the roving leaves the delivery drum 52, thereby assuring proper positioning of the roving R for effective shredding. The baffle plate 62 extends across the discharge plenum 48 and is curved arcuately in general conformance with the surface of the shredding drum 68, with the aforementioned curvature adjacent the delivery drum 52 and the curvature adjacent the shredding drum 68 forming an acute angle there between, around which angle the roving R passes from the delivery drum 52 to the shredding drum 68 to facilitate the shredding action and to facilitate retention of the roving R on the delivery drum 52 closely adjacent the shredding drum 68 to provide as short a space as possible therebetween for shredding of the roving into short pieces S. This baffle plate and the suction through the interior of the delivery drum 52 holds the roving back as the shredding drum 68 pulls short pieces therefrom and this action continues down to the last short end of the roving for effective shredding of the entire length of roving, which could not be done effectively with prior art devices.

The baffle plate 62 is also perforated adjacent the shredding drum 68 for drawing suction therethrough into the discharge plenum 48 to direct the roving R toward the shredding drum 68 to facilitate effective shredding action by the shredding drum 68, which shredding drum rotates counterclockwise (FIGS. 3 and 4) to act reversely on the roving R being delivered by the delivery drum 52, which also rotates counterclockwise, and to pull the roving in a shredding action against the baffle plate at the aforementioned acute angle formed therein.

Figure 8:
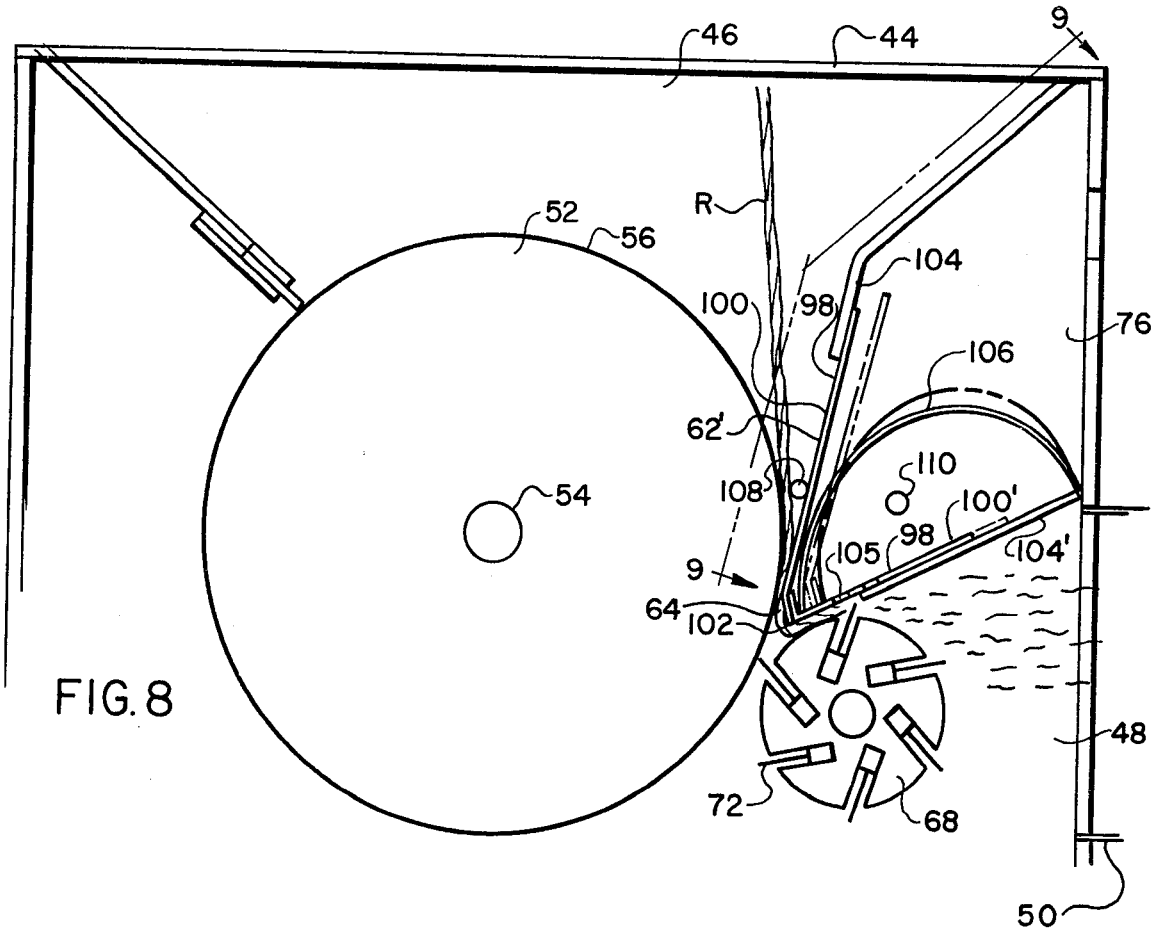
FIG. 8 is an enlarged vertical sectional view similar to FIG. 4, illustrating an alternate embodiment of the apparatus for shredding roving.
Figure 9:
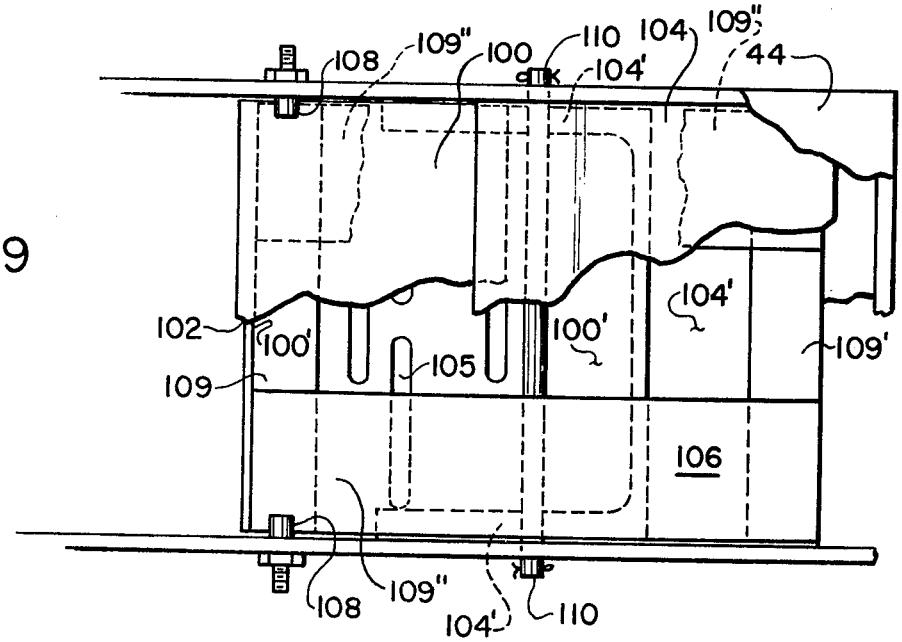
FIG. 9 is an enlarged vertical sectional view along line 9—9 of FIG. 8 and partially broken away, showing the alternate embodiment of the apparatus for shredding roving.

In the alternate embodiment of the shredding apparatus 24 of the present invention illustrated in FIGS. 8 and 9, the baffle plate (indicated therein as 62') is generally V-shaped having two walls 100 and 100' converging toward the delivery drum 52 to a vertex 102 closely adjacent the exterior surface 56 of the delivery drum 52 at the nip between the delivery drum 52 and the shredding drum 68. The baffle plate 62' is constructed of two generally flat stainless steel plates 98 each having a bend at one end to facilitate the joining thereof in the aforesaid V-shape by conventional means such as welding, and to create, as in the hereinabove described first embodiment, an acute angle around which the roving R passes from the delivery drum 52 to the shredding drum 68. The vertex 102 extends along the exterior surface 56 of the delivery drum 52 to define the aforementioned passage 64 therebetween and the lower wall 100' extends from the vertex 102 along the shredding drum 68 in close adjacency thereto. The baffle plate 62' is slidably mounted and retained in this disposition between two spaced guide plates 104 and 104' mounted in the housing 44 and extending therewithin in converging relationship toward the delivery drum 52 outwardly along the walls 100 and 100', respectively, in generally parallel relationship thereto. As in the first embodiment, the lower wall 100' is perforated or slotted as at 105 adjacent the shredding drum 68 for drawing of suction therethrough to direct the roving R toward the shredding drum 68, the lower guide plate 104' being generally U-shaped (see FIG. 9) thereby supporting the lower wall 100' primarily at the edges thereof and being open centrally to permit greater air flow through the slots 105.

A flexed steel spring 106 is disposed in the auxiliary plenum 76, engaging the baffle plate 62' at its vertex 102 oppositely of the delivery drum 52 and extending away from the delivery drum 52 into engagement with the housing 44, thereby yieldably biasing the baffle plate 62' toward the delivery drum 52 and toward the shredding drum 68 to permit movement thereof away from either or both the delivery drum 52 and the shredding drum 68 in response to either a downward or upward force exerted thereagainst to accommodate passage of varying size roving material through the passage 64 between the delivery drum 52 and the plate 62' and to accommodate passage of varying size roving material and shredded roving between the lower wall 100' of the plate 62' and the shredding drum 68 during transportation and delivery thereof from the delivery plenum 46 to the discharge plenum 48. Thus, when a larger than normal clump of roving material retained on the delivery drum 52 enters the passage 64, a generally downward force is exerted against the upper wall 100 of the baffle plate 62' causing the steel spring 106 to flex as the lower wall 100' of the plate 62' slides along the lower guide plate 104', as illustrated in FIG. 8. Similarly, when such a larger than normal clump of roving is engaged by the combs or saw blades 72 of the shredding drum 68 and is transported between the shredding drum 68 and the lower wall 100', a generally upward force causes flexing of the spring 106 and sliding of the plate 62' upwardly along the upper guide plate 104. In this manner, jamming of large clumps of roving material is prevented without the necessity of providing the clearance necessary in the first embodiment. In fact, the preferred spacing between the delivery drum 52 and the baffle plate 62' in the second embodiment is one eighth of an inch, and as a result, the adjustable end plate 66, employed in the first embodiment to aid in confining of suction to pass through the delivery drum 52, may be eliminated.

As can best be seen in FIG. 9, the spring 106 is constructed of four metal strips riveted together at the ends thereof in the form of a rectangle. One strip 109 forming one side of the rectangle engages the baffle plate 62' along the vertex 102 thereof oppositely of the delivery drum 52 and another strip 109', forming the side of the rectangle parallel to strip 109, engages the housing 44. The remaining two strips 109'' are formed of spring steel and extend transversely between strips 109 and 109' at opposite ends thereof in a partially flexed condition to facilitate further flexing thereof whenever downward or upward forces are exerted against the baffle plate 62'.

Additionally, first stop means is provided for limiting the biasing movement of the baffle plate 62' toward the delivery drum 52 to prevent contact therebetween and includes two stop rods 108 extending inwardly from the sides of the housing 44 at a location between the plate 62' and the delivery drum 52 for engagement with the baffle plate 62'. Second stop means, including a stop bar 110 extending across the housing 44 in the auxiliary plenum 76, is provided for limiting the yeilding movement of the baffle plate 62' away from either or both the delivery drum 52 and the shredding drum 68.

The present invention has been described in detail above for purposes of illustration only and is not intended to be limited by this description or otherwise to exclude any variation or equivalent arrangement that would be apparent from, or reasonably suggested by, the foregoing disclosure to the skill of the art.

I claim:

1. An apparatus for shredding textile roving or the like into short pieces comprising a housing formed with a delivery plenum into and through which a strand of roving may be drawn by suction and a discharge plenum through and from which shredded pieces of roving may be drawn by suction, a hollow perforated delivery drum mounted for rotation in said housing between said plenums and disposed for drawing of suction through the surface thereof at said delivery plenum interiorly across said drum and outwardly through the surface thereof at said discharge plenum, means for rotating said drum to transport roving received thereon at said delivery plenum and retained thereon by suction to said discharge plenum for discharge of the roving therefrom by the suction drawn through said drum and said discharge plenum, baffle means disposed between said plenums and closely adjacent the exterior surface of said drum for confining the drawing of suction primarily through said drum while allowing roving to be transported on said drum between said drum and said baffle means, and means in said discharge plenum adjacent said drum for shredding roving delivered thereto by said drum and suction.

2. An apparatus for shredding textile roving or the like according to claim 1 and characterized further in that said means for shredding is disposed adjacent said baffle means for shredding engagement of roving as it enters said discharge plenum from between said drum and baffle means.

3. An apparatus for shredding textile roving or the like according to claim 1 and characterized further in that said baffle means is perforated for drawing of suction therethrough into said drum to facilitate retention of roving on said drum between said drum and baffle means and to resist drawing of suction between said drum and baffle means from said delivery plenum.

4. An apparatus for shredding textile roving or the like according to claim 1 and characterized further in that said baffle means is yieldably biased toward said drum to permit movement of said baffle means away from said drum to accommodate passage of varying size roving material between said drum and said baffle means during transportation thereof from said delivery plenum to said discharge plenum.

5. An apparatus for shredding textile roving or the like according to claim 1 and characterized further in that said baffle means comprises a plate disposed adjacent said drum between said delivery plenum and said discharge plenum to define with said drum a passage for roving transported on said drum from said delivery plenum to said discharge plenum.

6. An apparatus for shredding textile roving or the like according to claim 5 and characterized further in that said plate is perforated for drawing of suction therethrough across said passage and into said drum to facilitate retention of roving on said drum in said passage and to resist drawing of suction through said passage from said delivery plenum to said discharge plenum.

7. An apparatus for shredding textile roving or the like according to claim 6 and characterized further in that said housing is formed with an auxiliary plenum extending to said plate for drawing of suction from said auxiliary plenum through said plate and passage into said drum.

8. An apparatus for shredding textile roving or the like according to claim 5 and characterized further in that said plate is yieldably biased toward said drum at said passage to permit movement of said plate away from said drum to accommodate passage of varying size roving material through said passage during transportation thereof from said delivery plenum to said discharge plenum.

9. An apparatus for shredding textile roving or the like according to claim 8 and characterized further in that said plate is generally V-shaped having two walls converging toward said drum to a vertex closely adjacent the exterior surface of said drum and extending therealong to define said passage therewith.

10. An apparatus for shredding textile roving or the like according to claim 9 and characterized further by spring means engaging said plate at said vertex oppositely of said drum and extending away from said drum into engagement with said housing for yieldably biasing said plate toward said drum at said passage.

11. An apparatus for shredding textile roving or the like according to claim 10 and characterized further by two spaced guide plates mounted in said housing and extending therewithin toward said drum, said guide plates being disposed outwardly along said walls of said plate for retaining said plate therebetween while biased by said spring means toward said drum and for guiding said plate during yielding movement thereof away from said drum, first stop means disposed between said plate and said drum and engagable with said plate to limit movement of said plate toward said drum and to prevent contact of said plate with said drum, and second stop means disposed on the side of said plate opposite said drum to limit yielding movement of said plate away from said drum.

12. An apparatus for shredding textile roving or the like according to claim 11 and characterized further in that said guide plates converge toward said drum in general correspondence with said two walls of said plate.

13. An apparatus for shredding textile roving or the like according to claim 5 and characterized further in that said plate extends adjacent said shredding means to confine roving closely to said shredding means as it leaves said drum.

14. An apparatus for shredding textile roving or the like according to claim 13 and characterized further in that said plate is perforated adjacent said shredding means for drawing of suction therethrough into said discharge plenum to direct the roving toward said shredding means.

15. An apparatus for shredding textile roving or the like according to claim 13 and characterized further in that said plate is yieldably biased toward said shredding means to permit movement of said plate away from said shredding means to accommodate passage of varying size roving and shredded roving material between said plate and said shredding means during delivery thereof from said drum to said shredding means and discharge thereof through said discharge plenum.

16. An apparatus for shredding textile roving or the like according to claim 13 and characterized further in that said plate is formed with an angle between said drum and shredding means around which angle the roving passes from said drum to said shredding means to facilitate shredding by said shredding means.

17. An apparatus for shredding textile roving or the like according to claim 16 and characterized further in that said shredding means is a toothed shredding drum mounted for rotation adjacent said delivery drum.

18. An apparatus for shredding textile roving or the like according to claim 17 and characterized further in that said plate is arcuately curved adjacent said delivery drum and arcuately curved adjacent said shredding drum with the angle therebetween being acute.

19. An apparatus for shredding textile roving or the like according to claim 17 and characterized further in that said plate is generally V-shaped having two walls converging toward said delivery drum to a vertex closely adjacent the exterior surface of said delivery drum at a point between said delivery drum and said shredding drum, one side wall extending adjacent to said shredding drum, said vertex forming said angle around which the roving passes.

20. An apparatus for shredding textile roving or the like according to claim 19 and characterized further in that said plate is yieldably biased toward said delivery drum and toward said shredding drum to permit movement of said plate away from said delivery drum to accommodate passage of varying size roving material between said delivery drum and said plate and to permit movement away from said shredding drum to accommodate passage of varying size roving and shredded roving material between said plate and said shredding means during transportation and delivery thereof from said delivery plenum to said discharge plenum.

21. An apparatus for shredding textile roving or the like according to claim 1 and characterized further in that said shredding means is a toothed shredding drum mounted for rotation adjacent said delivery drum and said baffle means extends adjacent said shredding drum to confine roving closely to said shredding drum as it leaves said delivery drum.

22. An apparatus for shredding textile roving or the like according to claim 21 and characterized further in that said baffle means is perforated adjacent said shredding drum for drawing of suction therethrough into said discharge plenum to direct the roving toward said shredding drum.

23. An apparatus for shredding textile roving or the like according to claim 21 and characterized further in that said baffle means is yieldably biased toward said shredding drum to permit movement of said baffle means away from said shredding drum to accommodate passage of varying size roving and shredded roving material between said baffle means and said shredding drum during delivery thereof from said drum to said shredding drum and discharge thereof through said discharge plenum.

24. An apparatus for shredding textile roving or the like according to claim 1 and characterized further by a pair of rotating nip rolls mounted on said housing at said delivery plenum for engaging the end of a strand of residual roving on a bobbin and for feeding the strand into said delivery plenum for drawing by suction to said delivery drum.

* * * * *